US008905027B2

(12) United States Patent
Selby et al.

(10) Patent No.: US 8,905,027 B2
(45) Date of Patent: Dec. 9, 2014

(54) PORTABLE COMPRESSION CHAMBERS

(76) Inventors: John Stephen Selby, Peel (GB); Peter Cronin Gordon, Liverpool (GB)

( * ) Notice: Subject to any disclaimer, the term of this patent is extended or adjusted under 35 U.S.C. 154(b) by 735 days.

(21) Appl. No.: 12/919,178

(22) PCT Filed: Feb. 23, 2009

(86) PCT No.: PCT/GB2009/000480

§ 371 (c)(1),
(2), (4) Date: Sep. 23, 2010

(87) PCT Pub. No.: WO2009/106797

PCT Pub. Date: Sep. 3, 2009

(65) Prior Publication Data

US 2011/0017215 A1 Jan. 27, 2011

(30) Foreign Application Priority Data

Feb. 25, 2008 (GB) ..... 0803388.8

(51) Int. Cl.

| | |
|---|---|
| ***A61G 10/00*** | (2006.01) |
| ***A62B 31/00*** | (2006.01) |
| ***B63C 11/32*** | (2006.01) |
| ***A61G 10/02*** | (2006.01) |

(52) U.S. Cl.

CPC ..... *B63C 11/32* (2013.01); *A61G 10/023* (2013.01); *A61G 10/005* (2013.01)

USPC ..... 128/205.26

(58) Field of Classification Search

USPC ..... 128/205.26, 200.24, 202.12, 202.14, 128/204.18; 600/21, 22

See application file for complete search history.

(56) References Cited

U.S. PATENT DOCUMENTS

| | | | | | |
|---|---|---|---|---|---|
| 4,467,798 | A | * | 8/1984 | Saxon et al. | 128/205.26 |
| 5,109,837 | A | * | 5/1992 | Gamow | 128/202.12 |
| 5,255,673 | A | * | 10/1993 | Cardwell et al. | 128/202.12 |
| 5,360,001 | A | * | 11/1994 | Brill et al. | 128/205.26 |
| 5,555,653 | A | * | 9/1996 | Morgan | 38/102.2 |
| 5,678,543 | A | * | 10/1997 | Bower | 128/205.26 |
| 5,738,093 | A | * | 4/1998 | Santi | 128/205.26 |
| 5,890,781 | A | | 4/1999 | Ryder | |
| 6,321,746 | B1 | * | 11/2001 | Schneider et al. | 128/202.12 |
| 7,501,579 | B2 | * | 3/2009 | Michael et al. | 174/126.1 |

(Continued)

FOREIGN PATENT DOCUMENTS

| | | | |
|---|---|---|---|
| GB | 2159862 A | * | 12/1985 |
| GB | 2 245 630 A | | 1/1992 |

(Continued)

OTHER PUBLICATIONS

International Search Report and Written Opinion of the International Searching Authority from International Application No. PCT/GB2009/000480.

*Primary Examiner* — Justine Yu
*Assistant Examiner* — Kathrynn Reilly
(74) *Attorney, Agent, or Firm* — Maschoff Brennan

(57) ABSTRACT

A compression chamber is formed by two end walls (10) and a flexible tubular member (11) extending between the end walls (10). The flexible tubular member (11) is formed from an inner tube (12) of air impermeable material and an outer tube (13) of a braided material. The inner tube (12) is unstressed when the chamber is filled with oxygen or air and the outer tube (13) bears the pressure load.

19 Claims, 7 Drawing Sheets

(56) References Cited

U.S. PATENT DOCUMENTS

Figure 1:
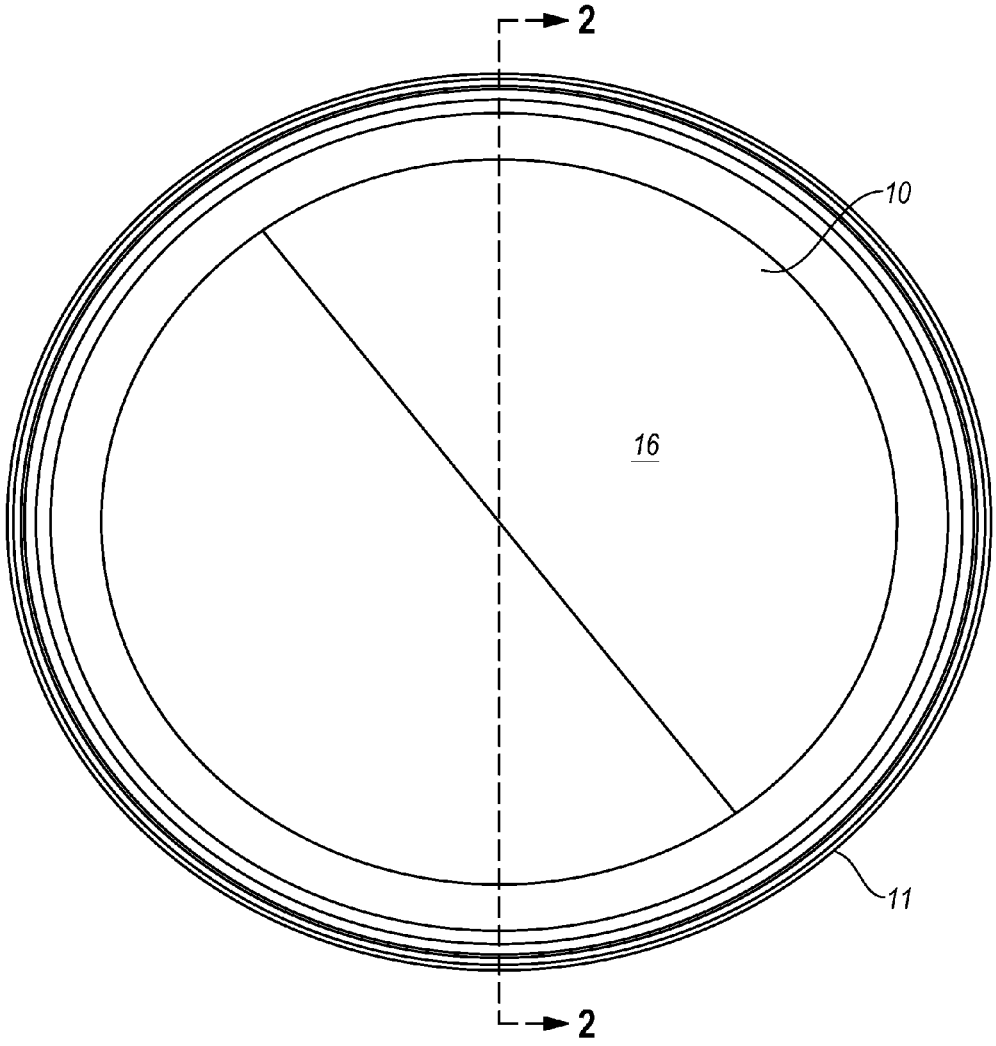

| | | | | |
|---|---|---|---|---|
| 7,634,999 | B2 * | 12/2009 | Lewis | 128/202.12 |
| 7,914,487 | B2 * | 3/2011 | Davies et al. | 604/103 |
| 2005/0113234 | A1 * | 5/2005 | Eagles et al. | 493/308 |
| 2006/0106444 | A1 * | 5/2006 | Michael et al. | 607/122 |

FOREIGN PATENT DOCUMENTS

| | | | |
|---|---|---|---|
| GB | 2 356 211 | A | 5/2001 |
| GB | 2356211 | B | * 12/2003 |
| WO | 96/28341 | A | 9/1996 |
| WO | 97/17931 | A | 5/1997 |

* cited by examiner

PORTABLE COMPRESSION CHAMBERS

The invention relates to portable compression chambers.

A compression chamber is an enclosed space into which a person enters and which is pressurised with oxygen or air at greater than atmospheric pressure. The person within the chamber breathes oxygen through a mask or hood while within the pressurised chamber. Conditions that can be treated in this way include decompression syndrome (sometimes called the bends suffered by divers, climbers and tunnelers), many medical conditions such as air or gas embolism, carbon monoxide poisoning, gas gangrene, thermal burns, crush injuries, other acute traumatic ischemia and many more.

Many such chambers are fixed installations to which persons are taken for treatment. It can be disadvantageous to a patient when suffering from, for example, the bends, to have to travel to a fixed installation. It is advantageous to be able to provide treatment as soon as possible.

For this reason, portable compression chambers have been developed. One example is disclosed in GB-A-2245630. In that arrangement, known as a hyperbaric stretcher, the chamber includes an elongate casing having end members where the casing comprises a flexible tubular wall of a silicone elastomer material incorporating windings of reinforcing filaments or yarns. The casing is formed by winding the filaments or yarns on a mandrel with the filaments or yarns pre-impregnated with a silicone elastomer precursor. The assembly is then cured.

It is a disadvantage of such an arrangement that the formation of the casing is complicated and results in a casing that is relatively heavy and inflexible making the chamber not easy to pack and transport.

According to the invention, there is provided a portable compression chamber comprising two end walls interconnected by a flexible tubular member to form an enclosed space for receiving a person to be treated, the flexible member being formed by an inner air-impervious material surrounded by tube of a seamless woven material.

By forming the flexible member from an air impervious material and an outer tube of seamless woven material, a member is provided that is lightweight and flexible. The air impervious material prevents leakage of air without being significantly stressed while the hoop stress created when the chamber is pressurised is taken by the woven material. Such woven materials, such as braided materials can be lightweight while providing readily the necessary strength.

Figure 2:
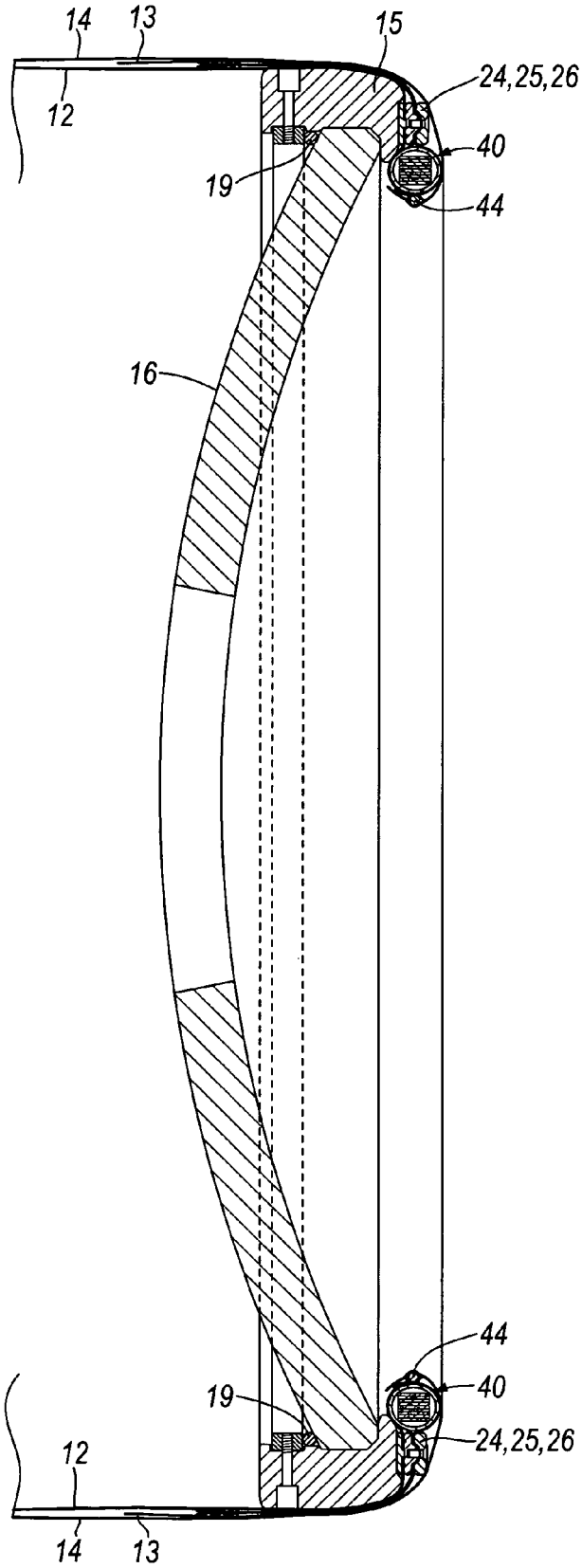
Figure 3:
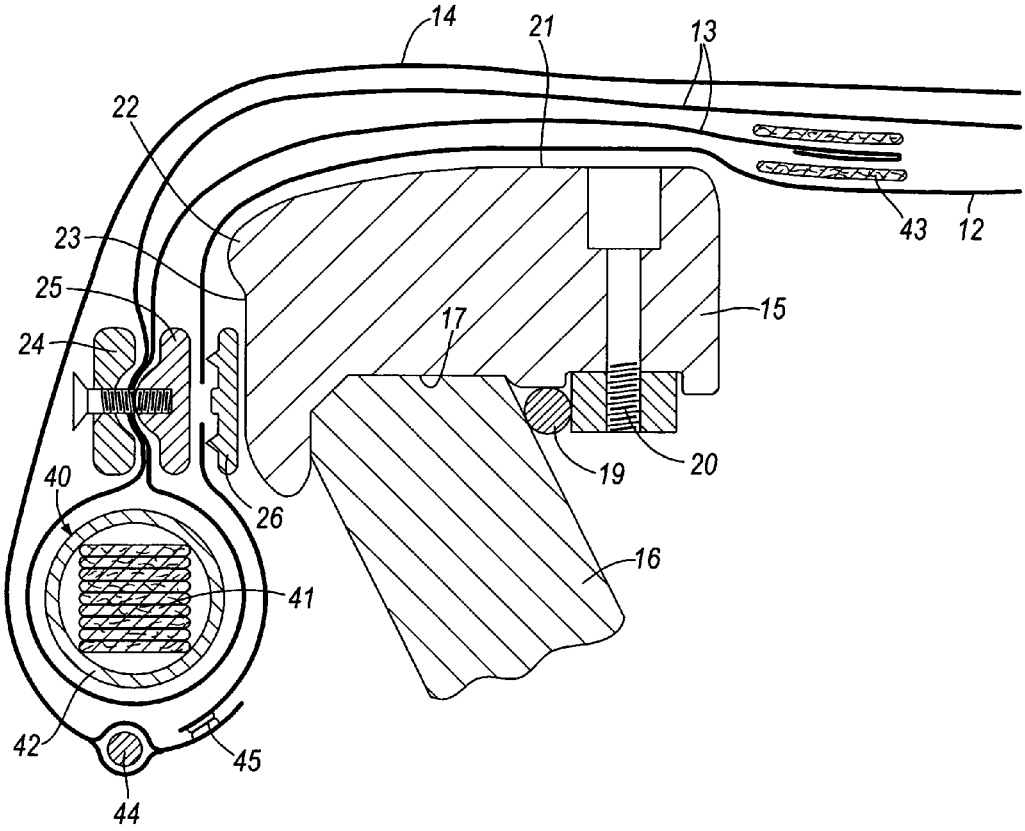
Figure 4:
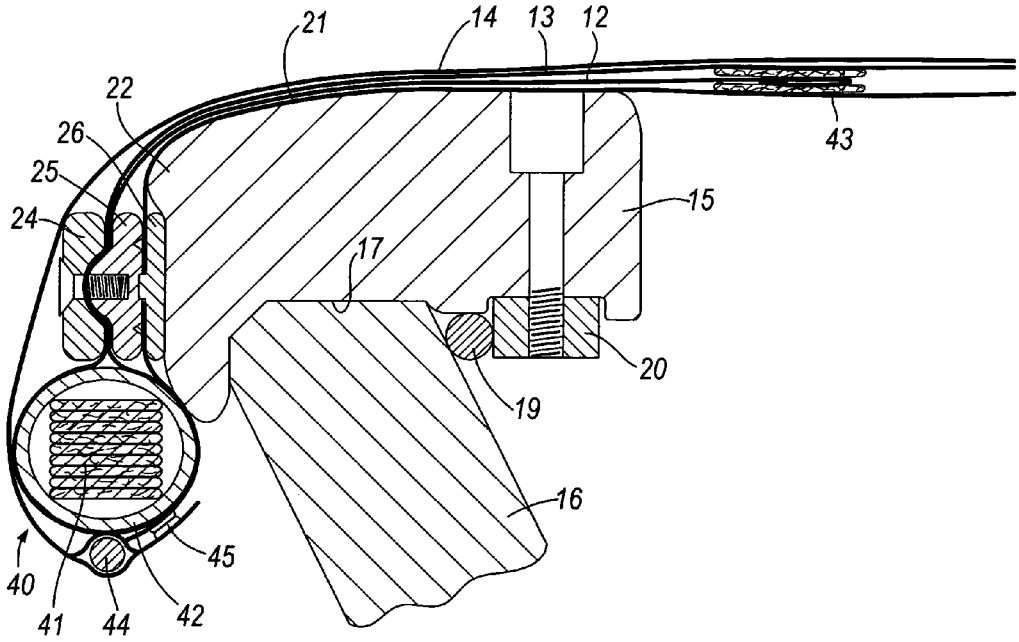
Figure 5:
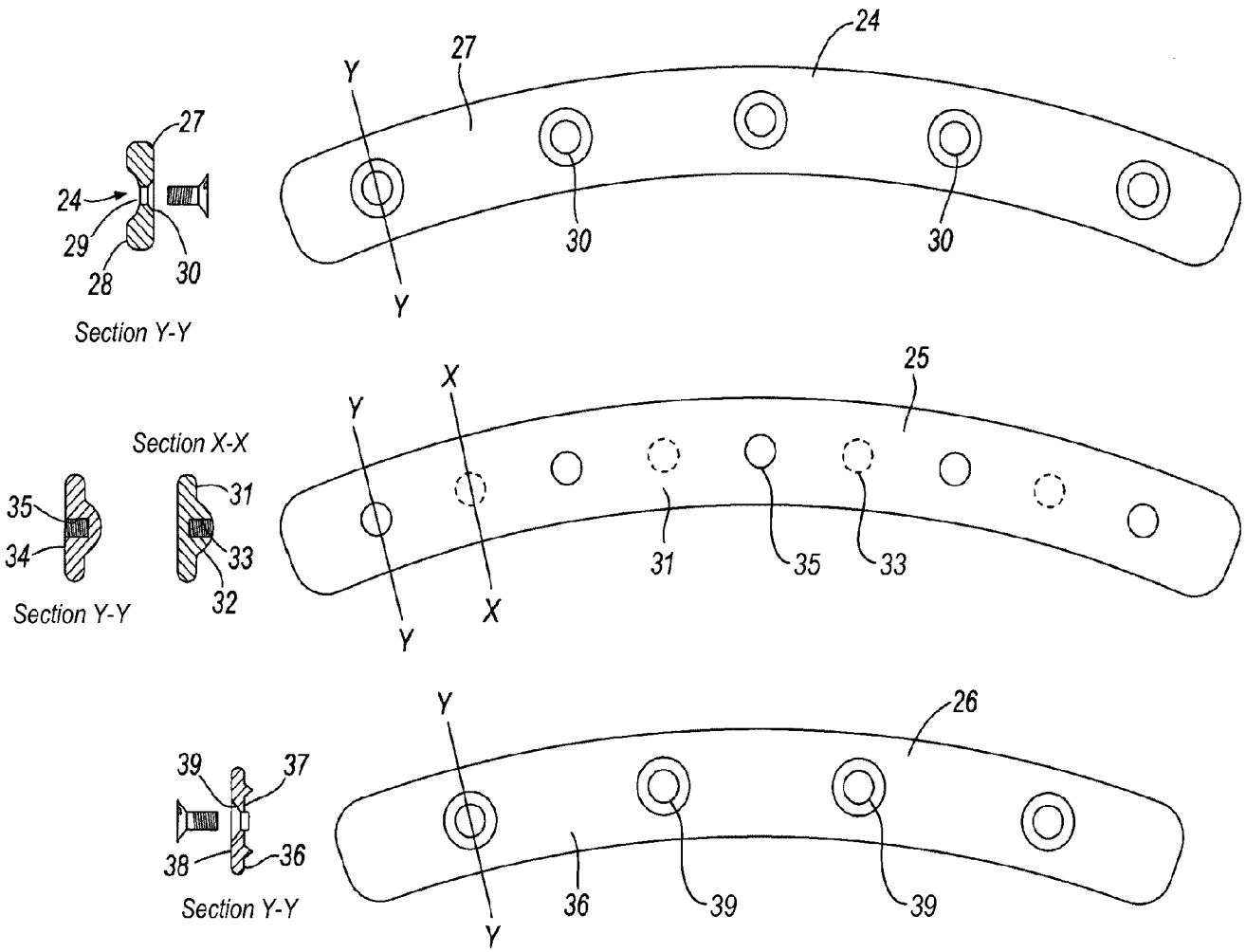
Figure 6A:
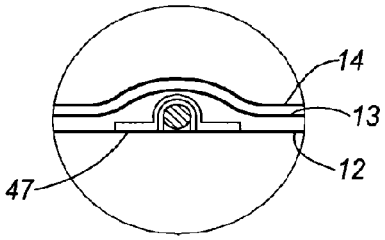
Figure 6:
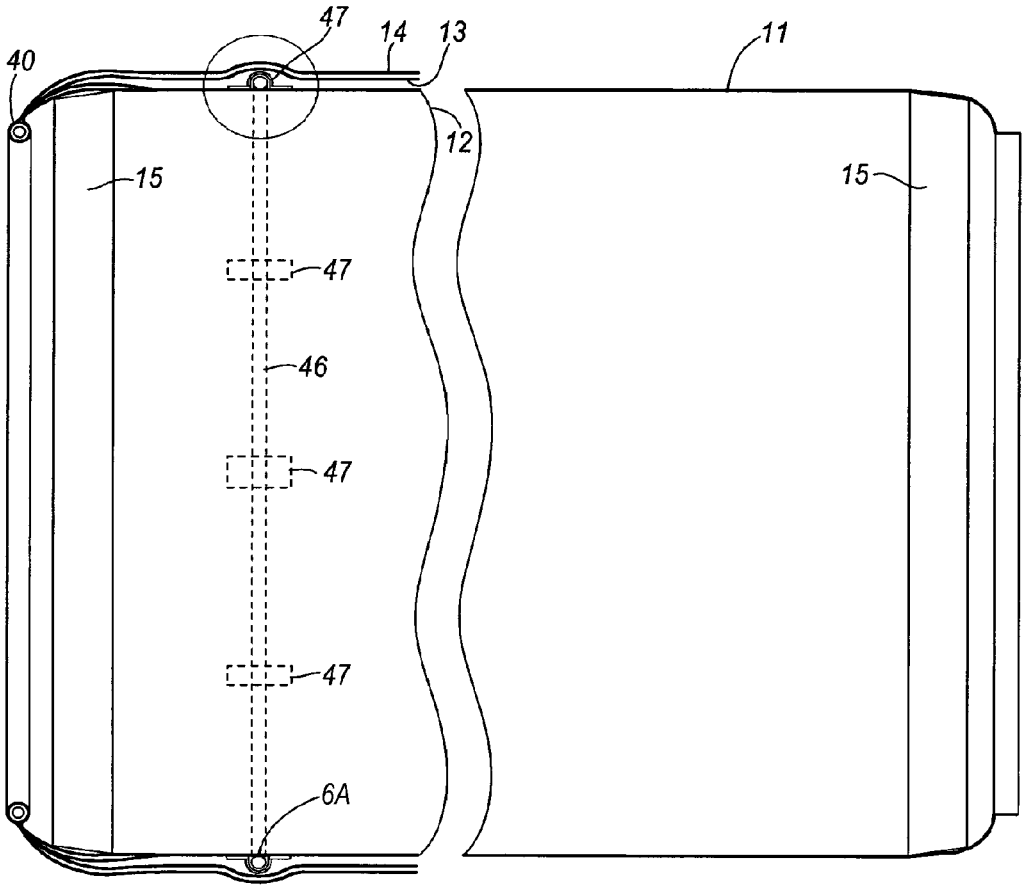
Figure 7:
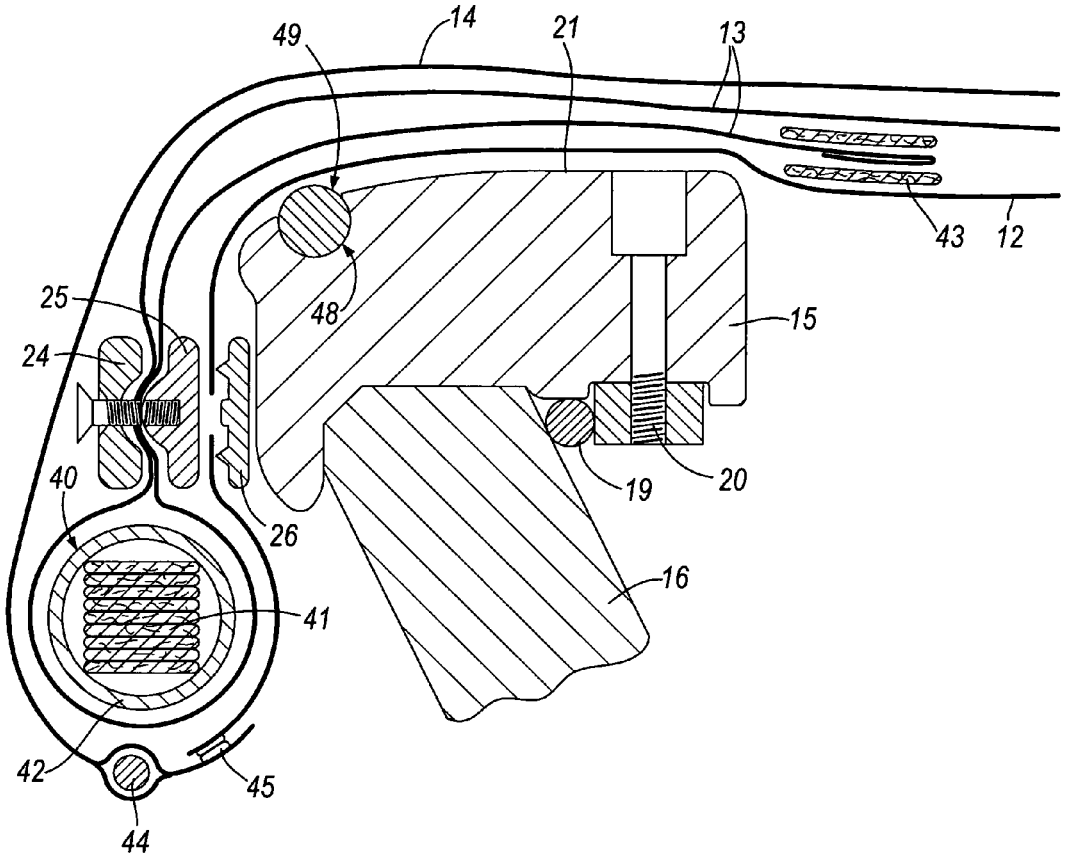

The following is a more detailed description of some embodiments of the invention by way of example, reference being made to the accompanying drawings, in which:

FIG. 1 is an end elevation of a portable compression chamber in the form of a hyperbaric stretcher, FIG. 2 is a partial cross-section of the hyperbaric stretcher of FIG. 1 on the line A-A of FIG. 1, FIG. 3 is a schematic detail of an interface between a protector ring of the stretcher of FIGS. 1 and 2 and a flexible tubular member of the stretcher, FIG. 4 is a similar view to FIG. 3 but showing the parts assembled and under pressure, FIG. 5 shows a set of clamp plates of the chamber of FIGS. 1 to 4 with the plates being shown in elevation and cross-section, FIG. 6 is a partial longitudinal cross-section of the stretcher of FIGS. 1 to 5 showing the inclusion of a hoop, FIG. 6A is an enlarged cross-sectional view of the stretcher of FIG. 6 showing the incorporation of the hoop into the stretcher, and FIG. 7 is a similar view to FIG. 3 but showing the provision of a seal on the protector ring.

Referring first to FIGS. 1 and 2, the hyperbaric stretcher is formed by two end walls, one of which is shown at 10, interconnected by a flexible tubular member 11. As seen in FIG. 3, the flexible member is formed by an inner tube 12 of air impervious material surrounded by a tube 13 of braided material. The inner tube 12 is, in its unstressed state, of a greater diameter than the diameter of the braided tube 13, for reasons that will be explained below. There is also a tubular outer cover 14.

The inner tube 12 may be formed from a polyurethane coated nylon material. The braided tube 13 may be formed of braided biaxial VECTRAN (Trade Mark). The outer cover 14 may be formed from a hard wearing woven nylon material such as ballistic nylon.

Each end wall, one of which is shown at 10, is formed by a protector ring 15 holding an acrylic window 16. As seen in FIG. 2, the protector ring 15 includes an annular L shaped channel 17 that receives a peripheral edge 17 of the window 16. The window 16 is held in place by a seal 19 connected to the protector ring 15 by circumferentially spaced fixings 20.

The protector ring 15 has a circumferential outer surface 21 that is convex in planes including the axis of the protector ring 15 and which decreases in diameter towards the outer-most end of the protector ring 15. At this outer-most end, the outer surface 21 leads to an annular nose 22 followed by an annular front surface 23 lying in a plane generally normal to the axis of the protector ring 15.

At their ends, the inner tube 12, the braided tube 13 and the outer cover 14 are connected together using an annular clamping ring of clamp plates. The clamping ring is formed by eight circumferentially spaced clamp plate segments of which one segment is shown in FIG. 5. Referring to that Figure, each clamp plate segment is arcuate and includes an arcuate outer clamp plate 24, an arcuate intermediate clamp plate 25 and an arcuate inner clamp plate 26. The clamp plates are made of aluminium and have a hard anodised finish. They are all arcuate with the same curvature.

The outer clamp plate 24 has a flat outer surface 27 lying in a plane normal to the axis of the arc of the plate and an opposed inner surface 28 formed with an arcuate groove 29. Five spaced screw holes 30 extend through the outer clamp plate 24 from the outer surface 27 to the inner surface 28.

The intermediate clamp plate 25 has an outer surface 31 lying in a plane normal to the axis of the arc of the plate and formed with an arcuate rib 32 along which are provided spaced blind screw holes 33. The intermediate clamp plate 25 has on apposed inner surface 34 that is flat and is also formed with spaced blind screw holes 35.

The inner clamp plate 26 has an outer surface 36 lying in a plane normal to the axis of the arc of the plate and formed with a groove 37 and an opposed inner surface 38 that is flat. Four screw holes 39 extend through the inner clamp plate 26 at arcuately spaced intervals.

Referring next to FIG. 3, the clamping ring, formed by the eight clamping plate segments, is used in the following way to clamp the ends of the inner tube 12, the braided tube 13 and the outer cover 14, at the ends of the stretcher. The clamping will be described with reference to FIG. 3 in relation to one clamp plate segment but it will be appreciated that the remaining clamp plate segments of the clamping ring will be similarly arranged.

Referring to FIG. 3, the braided tube 13 is clamped as follows. First, an end portion of the braided tube 13 is wrapped around an end ring 40. The end ring 40 is formed of a number of concentric loops of webbing 41 arranged in face-to-face contact to form a single loop. The webbing 41 is held in place by a tube 42 which may be formed from a flexible plastics material. The end ring 40 has a maximum diameter that is less than the minimum diameter of the protective ring 15, as seen in FIG. 3. After passing around the end ring 40, the end of the braided tube 13 is folded back on itself and the two layers are clamped between the inner surface 28 of the outer clamp plate 24 and the outer surface 31 of the intermediate clamp plate 25. These two clamp plates 24, 25 are connected together by screws passing through the screw holes 30 in the outer clamp plate 24 and engaging in the blind screw holes 33 on the intermediate clamp plate 25. In addition, the arcuate rib 32 on the intermediate clamp plate 25 enters the groove 29 on the outer clamp plate 24 to further lock the braided tube 13 against movement. The free end edge of the braided tube 13 is provided with two layers of webbing 43 to increase the thickness of the braided tube 13 and prevent it being pulled back through the outer clamp plate 24 and the intermediate clamp plate 25.

The end ring 40 can be a radially inexpandable end member.

The inner tube 12 has its free end clamped between the inner surface 34 of the intermediate clamp plate 25 and the outer surface 36 of the inner clamp plate 26. As seen in FIG. 3, the end of the inner tube 12 does not pass through these plates 25, 26 but terminates between the plates. The inner clamp plate 26 is connected to the intermediate clamp plate 25 by screws passing through the screw holes 39 in the inner clamp plate 26 and engaging in the blind screw holes 35 in the intermediate clamp plate 25.

The outer cover 14 extends over the braided tube 13 and the inner tube 12 and passes over the clamping plates 24, 25, 26, around the end ring 40 before its end is inserted between the intermediate clamp plate 25 and the inner clamp plate 26 with the end of the inner tube 12. The end of the outer cover 14 is thus held fast between these points. As seen in FIG. 3, in the region of the end ring, the outer cover 14 is provided with a draw cord 44 to allow the outer cover 14 to be tightened over the chamber and is also provided with connecting press studs, one of which is shown at 45, to allow the cover to be removed from the chamber.

Intermediate the end walls 10, the stretcher is provided with a number of axially spaced resilient hoops, one of which is shown at 46 in FIG. 6. Each hoop 46 is self-supporting and tends to maintain a circular shape. Each hoop 46 is contained in an annular support patch 47 that is glued or welded circumferentially around the outer surface of the inner tube 12. The purpose of the hoops 46 is to maintain the tubular shape of the chamber and prevent collapse.

The stretcher is assembled as follows.

First, the end walls 10 are prepared using the protective ring 15 provided with a window 16 as described above. Next, the ends of the inner tube 12, the braided tube 13 and the outer cover 14 are clamped and arranged as described above, with the incorporation of the end ring 40. An end wall 10 is then inserted into each end of the flexible member 11 formed by the inner tube 12, the braided tube 13 and the outer cover 14. It will be appreciated that the diameter of the protective ring 15 is greater than the diameter of the clamping ring formed by the clamp plate segments. In order to allow the protective ring 15 to pass these plates, the clamp plates 24, 25, 26 of each segment can be spaced circumferentially from adjacent segments so increasing the overall diameter of the clamp assembly and allowing insertion of the protective ring 15. This is allowed by the ability of the materials forming the stretcher to stretch or distend laterally and then retract the segments to a contiguous configuration.

After insertion, the protective ring 15 sits as shown in FIG. 3 with the inner tube 12, the braided tube 13 and the outer cover 14 extending over the outer surface 21 and with the clamp plate sets 24, 25, 26 sitting on the front surface 23 and with the end ring 40 radially inwardly of the protective ring 15. The relative dimensions of the parts ensure that the protective ring 15 is held firmly in this position.

In certain circumstances, it may be desirable to include a seal between the inner tube 12 and the protective ring 15. An embodiment of this is shown in FIG. 7 and parts common to FIG. 7 and to FIG. 3 are given the same reference numerals and are not described in detail. In this embodiment, the outer end of the outer surface 21 of the protective ring 15 is formed with a part-circular annular groove 48 that receives a circular cross-section O ring 49 whose outer periphery projects above the outer surface 21, where it is engaged by the inner tube 12 to provide a seal preventing the egress of air. For access to the interior of the stretcher, one of the windows 16 is removable. In addition, the other window 16 provides access to the interior of the chamber for gas hoses and other services. This may be arranged generally as described in GB-A-2245630.

In use, the assembled chamber is laid on a surface. The flexible member is held in a generally tubular configuration by the intermediate hoops 46. The removable window 16 is removed to allow access into the interior of the chamber for a person. A mattress (not shown) may be provided within the chamber for a person to lie on. The window 16 is then replaced and oxygen or air under pressure supplied to the interior of the stretcher. This may be to a differential pressure of up to 3 bar. This supply of oxygen or air will tend to expand the inner tube 12 but since the braided tube 13 will not expand beyond a maximum fixed diameter, and since that fixed diameter is less than the diameter of the inner tube 12, the inner tube 12 is not stressed or only minimally stressed by the increased internal pressure. This pressure will also force the protective rings 15 against the inner tube 12 to improve the seal between these parts. Since the inner tube 12 is not stressed, the clamping of only the ends of the inner tube 12 is sufficient. On the other-hand, the braided tube 13 experiences significant hoop stress. Any tendency of the braided tube 13 to pull through the outer clamp plate 24 and the intermediate clamp plate 25 is resisted by the end ring 40 and complete failure of the clamping is prevented by the webbing 43 on the end of the braided tube 13. As described above, where the stretcher is supplied with air, a person within the stretcher will breathe oxygen through a mask or hood. The stretcher may be lifted with a person within the stretcher.

The hyperbaric stretcher described above with reference to the drawings is light and compact. The interior of the inner tube 12 and the braided material 13 are of light weight and the cover may be of nylon. The stretcher is thus readily portable and easily deployed. A typical stretcher may be 3 meters in length and up to 1.2 meters in diameter with intermediate sizes possible. Although the stretcher above is intended to accommodate a single person, stretchers may be produced that are designed for accommodating two people simultaneously.

It will be appreciated that there are a number of changes that can be made to the arrangement described above with reference to the drawings. The braided tube 13 could be replaced by any tube of seamless woven material with the requisite hoop strength. The end ring 40 is optional and, where provided, it may be constructed other than as described above.

The clamping assembly need not be described as above but may take any suitable form.

The invention claimed is:

1. A portable compression chamber comprising:

two annular and substantially rigid end walls having a diameter and interconnected by a flexible tubular member to form an enclosed space for receiving a person to be treated, said tubular member being formed by an inner air-impervious material surrounded by a tube of a seamless woven material, the tubular member having first and second ends, each end held by respective first and second clamping means, wherein at least one of the first and second clamping means includes:

a plurality of circumferentially spaced and arcuate clamping segments together forming a clamping ring, the clamping segments configured to expand radially outwardly relative to one another to increase the spacing therebetween and allow the insertion of the end wall into the corresponding end of the tubular member, wherein after said end wall has been inserted into said end of the tubular member, the clamping ring of said tubular member engages the end wall and an annular seal is compressed between the tubular member and the end wall to provide an air-tight seal, and wherein each arcuate clamping segment comprises:

a first clamp formed between an inner clamp plate and an intermediate clamp plate and configured to secure the air impervious inner material; and a second clamp formed between the intermediate clamp plate and an outer clamp plate and configured to secure the seamless woven material.

2. The chamber according to claim 1, wherein the inner, the intermediate and the outer clamp plates are compressed together by fixing means.

3. The chamber according to claim 2 wherein the fixing means is a plurality of screws.

4. The chamber according to claim 1, wherein the seamless woven material extends through said second clamping means and passes around a radially inexpandable end member before passing through said second clamping means in a reverse direction.

5. The chamber according to claim 4 wherein the radially inexpandable end member has a diameter that is smaller than the diameter of said end wall.

6. The chamber according to claim 4 wherein said radially inexpandable end member is flexible.

7. The chamber according to claim 4 wherein said radially inexpandable end member is formed by webbing.

8. The chamber according to claim 7 wherein the webbing is formed by a plurality of annular strands of webbing.

9. The chamber according to claim 8 wherein the strands are contained within a tube.

10. The chamber according to claim 4 wherein the at least one end wall is annular about an axis and has an outer circumferential surface that is convex in planes including the axis, the convex outer surface facing said end of said tubular member, said tubular member extending around said convex outer surface with said tubular member being radially inwardly of said convex outer surface.

11. The chamber according to claim 4 wherein the seamless woven material after passing back through the second clamp, terminates in an end, the end of the seamless woven material being formed with a portion of increased thickness to resist the seamless woven material being drawn back through the second clamp.

12. The chamber according to claim 1 wherein a tubular outer cover is provided over said tubular member.

13. The chamber according to claim 12, wherein the tubular member has first and second ends, each being held by first and second clamping means and wherein said tubular outer cover has first and second ends, each end being clamped by a respective one of the clamping means.

14. The chamber according to claim 12 wherein at least one of the first and second clamping means is formed by a plurality of circumferentially spaced clamping segments together forming a clamping ring, the segments being able to be expanded radially outwardly relative to one another to increase the spacing therebetween to allow the insertion of said end wall and wherein each segment includes a first clamp for clamping said inner air-impervious material and a second clamp for clamping the seamless woven material and wherein said tubular outer cover is clamped by said first clamp.

15. The chamber according to claim 1 wherein at least one hoop is provided between the ends of the tubular member to support the tubular member.

16. The chamber according to claim 1 wherein each end wall includes a transparent cover.

17. The chamber according to claim 1 wherein at least one end wall includes a closable access.

18. The chamber according to claim 1 in combination with a supply of oxygen under pressure connected to the interior of the chamber.

19. The chamber according to claim 1 wherein the seamless woven material is a braided material.

* * * * *